US005108552A

United States Patent [19]

Desthomas

[11] Patent Number: 5,108,552

[45] Date of Patent: Apr. 28, 1992

[54] ELECTROPLATING PROCESS

[75] Inventor: Guy Desthomas, Veigy, France

[73] Assignee: Enthone-OMI, Inc., West Haven, Conn.

[21] Appl. No.: 735,597

[22] Filed: Jul. 25, 1991

[30] Foreign Application Priority Data

Aug. 17, 1990 [GB] United Kingdom ..... 9018116

[51] Int. Cl.[5] ..... C25D 17/00; C25D 21/00

[52] U.S. Cl. ..... 205/82; 204/198; 205/148

[58] Field of Search ..... 204/14.1, 198

[56] References Cited

U.S. PATENT DOCUMENTS 2,958,331 11/1960 Borodin ..... 204/198

*Primary Examiner*—T. M. Tufariello

*Attorney, Agent, or Firm*—Richard P. Mueller; Kenneth A. Koch; John J. Tomaszewski

[57] ABSTRACT

A process for electrodespositing a conductive material on a substrate is disclosed which comprises movably mounting the substrate in a first conductive liquid electroplating bath which contains the conductive material, maintaining substantially constant conditions of temperature and liquid circulation in the first bath, passing an electric current through the substrate and the first bath so as to deposit the conductive material on the substrate, periodically transferring the substrate to a second liquid bath, the second bath containing a liquid of the same composition or lower concentrations of dissolved ingredients as compared to the first bath, weighing the substrate when immersed in the second bath and calculating therefrom the weight in air of conductive material deposited, returning the substrate to the first bath, and continuing the plating in a series of stages of plating, weighing in liquid and plating until the desired deposit is built up.

Apparatus for carrying on the method is also disclosed.

10 Claims, 2 Drawing Sheets

ELECTROPLATING PROCESS

Figure 1:
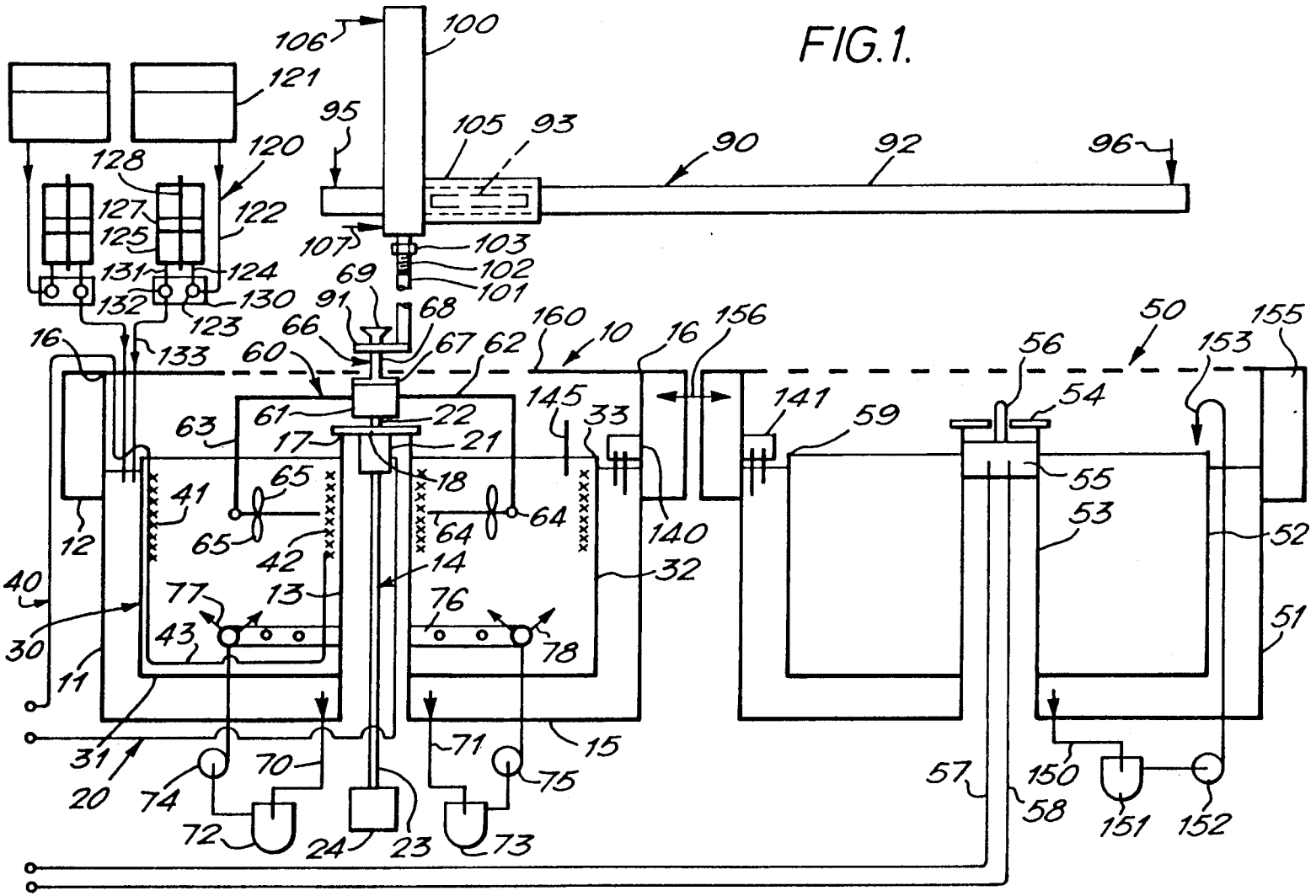

The present invention relates to a process and apparatus for electroplating in particular electroforming gold jewellery.

In a known such electroforming process a computer actively controls various parameters during electroforming and approximately every hour the workpiece is removed from the bath and dried and weighed to assess the amount of gold alloy present. This enables the operator to calculate the plating efficiency and this is used to programme the computer and used to reset the various parameters. This process suffers from the disadvantage that each drying and weighing procedure takes about half an hour.

We have found that the process can be made more rapid and accurate by transferring the workpiece to a water bath and weighing the workpiece while in the water bath. This allows one to make the calculations required while the workpiece is in the water bath without the need for drying.

According to the present invention a process for electrodepositing a conductive material on a substrate, e.g. a rack or jig of workpieces, comprises movably mounting the substrate in a first conductive liquid, preferably aqueous, electroplating bath which contains the conductive material, preferably a source of one or more metal ions, maintaining substantially constant conditions of temperature and liquid circulation in the first bath, passing an electric current through the substrate and the first bath so as to deposit the conductive material on the substrate, periodically transferring the substrate to a second liquid bath, preferably whilst maintaining the current supply to the first bath, the second bath containing a liquid of the same composition or lower concentrations of dissolved ingredients as compared to the first bath, weighing the substrate when immersed in the second bath and calculating therefrom the weight in air of conductive material deposited, returning the substrate to the first bath, calculating the deposit composition needed for the next plating stage to achieve the final desired overall value for the deposit, and adjusting the plating current to produce the desired composition of the deposited conductive material in the next plating stage which may be the final stage or not.

The plating process is preferably carried out in four or more stage e.g. 4, 5 or 6 and the electroplating bath is preferably aqueous and the second liquid bath or weighing liquid is preferably substantially pure water, optionally containing 0.00001 to 0.00005% of wetting agent, preferably that used in the first or plating bath, and optionally 0.00001 to 0.00005% of one or more of the conductive salts used in the plating bath.

The liquid in the weighing bath is preferably circulated and the substrate is dipped one or more times e.g. twice into the liquid while it is being circulated, the circulation is then switched off and the substrate is weighed repeatedly until the variation in the measured value is stable to within the accuracy of the measuring device, which is typically ±0.01 grams.

In an alternative preferred form of the process the second or weighing liquid bath is of the same composition and concentration as that in the first or electroplating bath.

The invention also extends to apparatus for electrodepositing a conductive material on a substrate which comprises a first electroplating bath for containing an electroplating liquid, means for movably mounting a substrate in the said bath, means for maintaining substantially constant conditions of temperature and liquid circulation in the first bath, means for passing an electric current through the substrate in the first bath so as to deposit the conductive material on the substrate, a second bath for containing a weighing liquid and means for weighing the substrate when immersed in the weighing liquid, means for transferring the substrate from the first to the second bath preferably whilst maintaining the current supply to the first bath, and means for transferring the substrate from the second bath to the first bath.

The transfer means are preferably hydraulically driven.

In one convenient form of the invention the transfer means comprise vertical lifting means for lifting the substrate in and out of the bath and transverse shifting means for moving the vertical lifting means from above one bath to above the other bath.

The vertical lifting means preferably comprise a cylinder with a bore of non-cylindrical cross-section in which a piston of matching cross-section is disposed which carries lifting means for the substrate: this prevents twisting of the piston in the bore.

The transferse shifting means preferably comprise a piston in a cylinder which affords a bearing surface for the vertical lifting means, the vertical lifting means being adapted to run along the said cylinder, the transverse piston and the vertical lifting means being magnetically coupled so that movement of the transverse piston in the cylinder causes corresponding transverse movement of the vertical lifting means.

A preferred form of the apparatus is designed for fully automatic electroforming of carat gold jewellery. The equipment consists of two tanks, one to hold the gold plating electrolyte and one to hold the gold dragout solution which is used as a weighing tank.

A transfer device is provided to move the plating rack from the plating tank. The preferred transfer device is a hydraulic hoist which uses domestic water as the hydraulic fluid. Water is used to ensure a smooth transfer of the rack to the balance.

An accurate balance is situated in the centre of the dragout tank and it affords a weighing spindle on which the jig is placed to allow weighing of the plating jig, complete with workpieces, in the dragout solution. The computer integrates the weight in the solution with the Archimedes forces to obtain the true weight in air.

A control module houses the rectifiers, amperminute meters, controls for the heaters, controls for the filter pumps, controls for the solution level devices and the computer which controls the total system.

A cabinet is provided to completely enclose the tanks and transfer mechanisms so that the atmosphere around the tanks can be extracted to the outside of a factory unit.

A computer keyboard, monitor and printer is provided to enable the operator to input information to the computer control system.

The computer control system preferably maintains the temperature of the solutions to ±0.1° C. and controls and adjusts the plating current. The computer also calculates the quantities of materials consumed and automatically adds the required amounts to the plating bath to maintain the required concentrations. The computer automatically weighs the workpieces before and after plating to give accurate weights of the amount of metal which has been electrodeposited. The computer adjusts the plating current and thus current density to enable there to be accurate control of the carat value of the gold alloy which is deposited.

The equipment provides a system which will electroform a gold alloy of given carat value with increased accuracy.

The system differs from previous equipment in that the jig of parts is placed in the machine and is then handled automatically until the completion of the plating cycle. Previously the jig of parts was manually weighed, manually dried and information manually fed to the computer control system.

The new system weighs the jig and components in a dragout solution of constant density and not in air. This means that the parts do not have to be dried before weighing which eliminates weighing errors due to incomplete drying. The elimination of weighing errors eliminates errors in solution efficiency measurements which gives increased control over the carat value of the deposited alloy.

Figure 2:
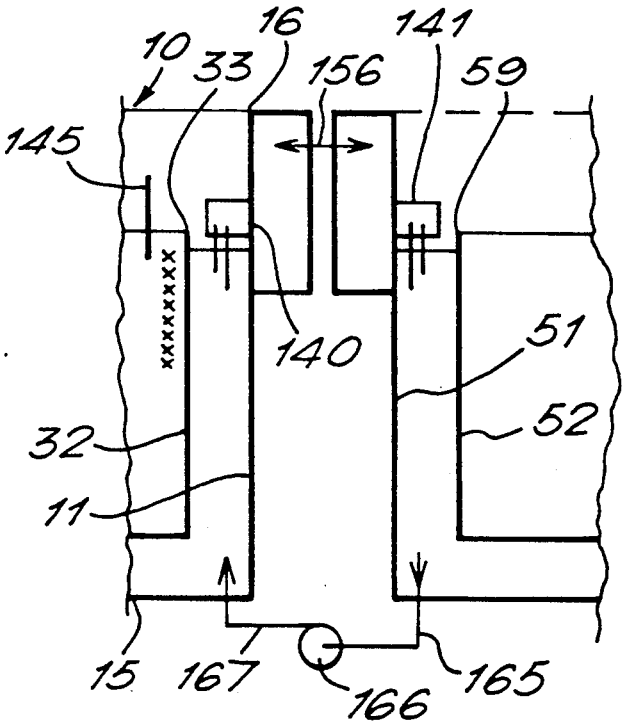

The invention may be put into practice in various ways and one specific embodiment will be described to illustrate the invention with reference to the accompanying drawings, in which:

FIG. 1 is a diagrammatic front elevational view of a preferred embodiment of the apparatus of the present invention; and FIG. 2 is a view of part of FIG. 1 showing a modified arrangement.

The apparatus consists of two tanks of similar or same size and construction, one 10 providing an electroplating bath, and the other 50 providing a weighing bath with a jig 60 (shown in FIG. 1 in the electroplating position in the bath 10) and a jig transfer mechanism 90. The tank 10 is provided with a make-up supply mechanism 120 and the tank 50 with a weighing device or balance 56.

The operation of the apparatus is under the control of a conventional microcomputer (not shown) to which the various sensors valves, heaters, current supplies and motors included in the apparatus are connected in conventional manner.

The tank 10 has an outer stainless steel shell 11 of square plan and rectangular elevation provided with a water jacket 12 around its upper third. This is kept filled with distilled water which heats up to the temperature of the plating bath by conduction. This heated distilled water is used to top up the plating bath to compensate for evaporation. The plating bath is provided with heaters and sensors (not shown) operatively connected to the computer so that a desired temperature (typically 65 to 70° C. for a gold, copper, cadmium deposit) can be maintained in the jacket. The tank affords a circular inner core 13 which houses a drive mechanism 14 and electricity supply 20 for the jig 60. Secured in annular form around the core 13 is an annular tank 30 of non-conducting material e.g. Perspex. The base 31 of this is spaced from the base of the outer shell 11. The side wall 32 of this stops at the top edge 33 short of the top edge 16 of the outer walls of the shell and also short of the top edge 17 of the inner core 13 of the outer shell 11.

The edge 33 forms a weir and may be provided with a stepped configuration so as to be lower, e.g. by about 1 cm, at the rear of the tank compared to the front of the tank. This encourages mixing as the liquid overflows preferentially from the rear of the tank 30 and can assist in dissolving solids which may be added during the process at the back of the tank to make up the concentrations of the electroplating ingredients.

The power supply 20 to the jig forms one limb of the electroplating circuit and feeds current to the jig as the cathode (negative) via a sliding contact housing 21 which electrifies a drive spindle 22 on which the jig is drivingly but removably mounted. The drive spindle 22 is driven in appropriate manner by a drive shaft 23 from a reversible variable speed motor 24 again under control of the computer as to speed, direction of rotation, number of rotations in a given sense and rest times between changes in direction.

The electroplating circuit is completed by a power supply 40 which feeds two annular electrodes, 41 and 42, disposed around the upper half of the annular tank 30. One, 41, is located against the side wall 32 just below the top 33 of the wall and the other, 42, against the core 13 at the same level. The core 13 is sealed at its top 17 by an insulating plate 18 from which the sliding contact housing 21 depends and through which the drive spindle 22 passes.

The two electrodes are connected in series as anodes (positive) by a strap 43, which passes over the edge 33 of the tank 30 down behind the electrode 41, down the outer wall 32, along the base 31 and up the core 13 to the other electrode 41.

The electrodes are preferably made of platinized titanium mesh and the strap 43 is also preferably made of platinized titanium.

The electroplating circuit is also under the control of the computer by which it can be switched on and off and its voltage and current varied. The computer is arranged to count the time for which the current flows and the value of the current in amps so that it can detect when a certain value of amperminutes has been reached.

The electrodes are dimensioned so as to extend above and below the level of the workpiecs which will be attached in use to the jig and to be equidistant radially e.g. 7–8 cms from the workpieces.

The jig 60 has a current conducting, e.g. bronze, central boss 61 from which extend, e.g. horizontally, six stainless steel arms 62 from each of which depends, preferably vertically, a leg 63, which is covered with an insulating coating so as to avoid electrodeposition thereon, the arms dipping into the bath during electroplating. The bottoms of the arms 63 are connected by a workpiece support ring 64. This has conductively connected to it the workpieces 65 which are to be plated, e.g. by a tin lead solder if the model is made of tin lead. In FIG. 1 these are earrings shown diagrammatically and for clarity as just four items, two above the ring (upside down) and two below the ring 64. In practice they are closely spaced around the ring typically as many as one hundred being plated at a time.

The workpieces are moulded or otherwised shaped conductive metal items e.g. made of zinc, aluminium or bronze.

The jig 60 also has a lifting member 66 made of non-conductive material e.g. polypropylene. This consists of a foot or plate 67 secured to the top of the boss 61 from which rises a stem 68 which flares out at the top into a cone 69. The cone can be engaged by a lifting hook 91 on the transfer mechanism without current passing.

The boss has an internal profile which closely conforms to the spindle 22 though it must be able to be readily and smoothly lifted from the spindle. Sliding contact structures of conventional type e.g. of split sprung ring type are conveniently used.

Positive rotational drive is ensured between the boss and the spindle e.g. by having a transverse slot in the top of the spindle and a cooperating rod located in the boss, adapted to fit loosely in the slot.

The electrolyte during plating has to be kept at constant temperature and under constant agitation conditions. The shell 11 thus also houses heaters (not shown) under the control of the computer as well as an electrolyte circulation mechanism. This consists of a pair or more outlet pipes 70 and 71 drawing electrolyte from the base 31 of the centre of the outer shell next to the central core 13 and feeding it via filters 72, 73 and pumps 74, 75 to a distribution ring 76 in the tank 30 having a ring of outlet holes 77 facing upwardly and outwardly and 78 facing upwardly and inwardly.

The pumps 74 and 75 are under the control of the computer so that circulation can be varied as desired. The filters are preferably wound polypropylene yarn such as to remove all particles above 1 micron During electroplating the bath will become depleted of those ingredients which are being deposited on the workpieces. Accordingly a make up mechanism 120 is provided. This has for example two separate supply systems and so is able to make up two ingredients or two batches of ingredients.

Each supply system has a reservoir 121 which feeds by gravity through a pipe 122 to a valve housing 30 containing a valve 123. This is connected via an upwardly directed pipe 124 to a cylinder 125 containing a piston 127, floating on a rod 128 and acted on by gravity. The cylinder 125 is located between the reservoir 121 and the housing 130.

A pipe 131 leads from the cylinder 125 to the housing 130 and a second valve 132 which feeds a pipe 133 leading down to the shell 11 outside the tank 30.

Opening the valve 123 allows liquid to flow under gravity from the reservoir into the cylinder 125 forcing the piston up. The amount of liquid drawn into the reservoir depends on how long the valve 123 is left open.

The valve 123 is then shut and the valve 132 opened. The liquid then flows out from the cylinder 125 under the weight of the piston 127 through the pipes 131 and 133 and valve 132. Again the amount flowing depends on the time for which the valve 132 is open. Both valves are under the control of the computer.

The jig transfer mechanism 90 has a horizontal cylinder 92 of square external profile containing a free floating piston 93. The cylinder is fed via a valve system (not shown) with mains water (e.g. at 4 bars pressure) (preferably provided with a pressure regulator to even out any fluctuations) to inlet ports 95 and 96 at either end of the cylinder The valve mechanism under control of the computer can admit water to one port e.g. 95 while venting it from the other 96 so as to drive the piston 93 towards the tank 50 and vice versa.

The jig transfer mechanism also has a lifting mechanism. This consists of a vertical cylinder 100 having a non-cylindrical e.g. oval bore in which a matching piston (not shown) is located. The non-cylindrical shape ensures that the piston cannot twist or rotate in the cylinder. The piston carries a lifting rod 101 (which is adjustable in length by means of a thread 102 and nut 103 structure). (The rod 101 is shown broken to save space in the drawing.) The rod 101 carries the lifting hook 91 at its lower end. This hook is a horizontal plate with a cut out wider than the stem 68 of the lifting member 66 but narrower than the cone 69. The cut out widens into a circular area which is smaller than the cone 69. This provides secure support for the jig during transfer between the tanks but ready disengagement during electroplating or weighing of the jig.

The cylinder 100 is mounted on a housing 105 which runs along the flat top of the cylinder 91 e.g. on wheels or a bearing surface (not shown). The housing 105 is or includes a magnet (or may be electrically magnetized) under control of the computer. The magnetic attraction between the housing 105 and the piston 92 in the cylinder 90 is arranged to be sufficient for movement of the cylinder 92 to draw the lifting mechanism carrying the jig along the cylinder 91.

The vertical cylinder 100 is fed via a valve system with mains water in the same way as the cylinder 91 via ports 106 and 107, the valve mechanism being under the control of the computer as already described.

The weighing tank 50 is of closely similar structure to the tank 10 having an outer vessel 51 and an inner vessel 52 but this is made of stainless steel. The inner core 53 of the outer vessel in this case is closed by an insulating cap 54. A precision balance 55, preferably accurate to 0.01 gram, is housed inside the core near its top end. The balance has output cables 57 and 58 connected to the computer. The balance has a weighing spindle 56, of the same shape as the spindle 22, but without the electrical contact spring, extending through the cap.

The relationship between the top of the spindle 56 and the top edge 59 of the tank 52 is arranged to be the same as that between the top of the spindle 22 and the top edge 33 of the tank 30. This ensures that the jig is immersed to the same depth in each tank. In order to facilitate this level control (as well as being a control on the rate of circulation and a safety control for the circulating pumps to stop them running dry) each tank 10 and 50 is provided with a liquid level sensor 140 and 141 having two electrodes dipping into the liquid between the outer and inner tanks. The tank 30 is also provided with a temperature sensor 145 located near the top of the tank.

These sensors 140, 141 and 145 supply signals to the computer which controls the heaters and pumps to maintain the desired temperature and liquid circulation values.

Circulation in the tank 50 is only needed to ensure that neither density nor temperature variations build up. This is achieved by withdrawing liquid from the base of the outer tank via a pipe 150 and feeding it via a filter 151, a pump 152 and a line 153 back smoothly into the top of the tank 52 near its edge 59. This ensures that the weighing liquid is kept free of solid impurities. The rate of circulation is such that it does not interfere with the weighing.

The tank 51 is also provided with a water jacket 155 the same as the jacket 12 around the tank 11. The two jackets 12 and 155 are interconnected as indicated at 156. The tank 50 may also be provided with heaters, located between the outer shell 51 and the inner tank 52, under control of the computer, so that the temperature in the tank 52 can be kept the same as in the tank 30 if desired.

The tank 10 is provided with an apertured plastics e.g. perspex cover 160 having a circular hole indicated by dashed lines of a diameter slightly larger than that of the jig. This helps reduce evaporation losses from the tank whilst allowing the jig to be lifted in and out.

The mode of use of the apparatus will now be described.

With the jig removed the desired electroplating composition is placed in the tank 10 and the heaters and pumps switched on and the desired values of bath temperature and circulation rate set in the computer which then brings the system up to the set values and holds them.

The appropriate make-up solutions are placed in the reservoirs 121 and the necessary calculations made as to make up volumes (and thus valve open times) and frequencies of addition and these are input to the computer.

The desired current density values for the workpieces and the composition to be deposited are calculated and the appropriate current settings are input to the computer.

The degree of agitation required and thus the rate of rotation of the jig, the times of rotation and the times between changes in rotation is decided upon and the values input to the computer.

The workpieces are conductively attached to the jig in appropriate orientation to facilitate the necessary degree of agitation in the bath as is known in the art.

The surface area of the workpieces is deduced by an analysis related to shapes having known surface areas, and the increase in surface area for a given thickness of deposit calculated.

A first jig of workpieces of thus deduced surface area and a reference piece of accurately measurable area can then be compared by plating in the same bath. The jig of workpieces is weighed first in air without the reference piece which is weighed in air and is then attached and the jig weighed again. The jig is then plated and then weighed. The reference piece of known area is then detached and weighed in air and its weight recalculated as if measured in liquid The jig is then weighed in liquid. One then knows the weight of deposit of known density and accurate surface area and the weight of deposit on the workpieces of unknown area. The deposit compositions are the same and assuming the same thickness of deposit on the reference and workpieces one can accurately calculate the surface area of the workpieces.

When alloy compositions are being deposited such as the known gold, copper, cadmium or, gold, copper deposits one skilled in the art will have experience as to the relationship between the efficiency of elecroplating and thus the carat value and the inverse of the current density which will be a straight line for the region at lower rather than higher current densities. Efficiency is the weight of the deposit in milligrams divided by the amperminutes required to produce the deposit. From this relationship an appropriate current density for the desired carat value can be selected. Knowing the surface area the current can then be selected.

The efficiency of plating for such alloys is very dependent on such factors as temperature and agitation. Accordingly for a new set up or different conditions plating is best carried out initially with workpieces of known area and the current density accurately varied in steps to produce different accurately known plating efficiencies from the accurate measured weight of deposit and amperminute values. The efficiency can then be related to the deposit composition by analysis of the deposits.

The user is thus in a position where he knows what current density will be needed to achieve a given efficiency and thus carat value with a given set-up of bath configuration, electrolyte composition and temperature and will also accurately know the surface area of the workpieces and the increase in surface area for a given deposit thickness. He can thus accurately set the current density at each stage.

When a deposit of a desired thickness and composition is required, the conventional practice has been to plate the workpieces in a number of stages and to weigh the workpieces after drying between each plating stage. The operator thus also inputs the number of plating stages to be used. The current efficiency and thus carat value is calculated from the increase in weight of the deposit and the total amperminutes supplied in the plating stage. The computer also calculates the increase in surface area from the weight deposited and the input increase in area expected for a given thickness of deposit The computer then adjusts the current to achieve the necessary current density required for the next stage. The first stage will usually be run to give a lower carat value than the target value and the next stage then run to give a higher value than the target value. From these two values the line appropriate to the particular operating conditions on the day can be established and the required amperminute values, needed to achieve the target carat value at the end of all the deposition steps, deduced Each stage is controlled by the computer counting the amperminutes and when the necessary value has been reached for that plating stage actuating the transfer mechanism cylinder 100 to raise the jig out of the bath thus terminating the plating for that stage.

The accuracy of this iterative process depends closely on the accuracy of the weighing. The workpieces which it is wished to plate often have shapes which occlude moisture making them difficult to fully dry. In addition the drying process requires several rinsing steps e.g. dragout bath rinse, water rinse, alcohol rinse, air blast drying each of which take time and produce an effluent. In addition the workpieces must be properly wetted before plating is recommenced and this requires a dip in a wetting agent bath, a water rinse and a dragout rinse before reimmersion in the plating bath.

We have realized that if the weighing can be done without drying a more accurate and more rapid process can be achieved. When there are inaccuracies in weighing the user cannot be certain that he will achieve a given carat value and thus be sure that his products will pass assay. Thus e.g. for a stated or advertised 18 carat product he must aim to plate at a higher value than 18 carat thus wasting gold. The more accurate the process the closer can he set his target deposit content to his stated or advertised carat value.

However as mentioned above the plating conditions are very sensitive to the physical conditions in addition to the chemical ones. Accordingly we minimize perturbation of the temperature and agitation conditions in the plating bath by maintaining these constant as far as possible i.e. maintaining heating and circulation of electrolyte and continuous filtration thereof. This is achieved by removing the jig from the plating tank and after a drip period transferring it to a weighing bath in which it is immersed to exactly the same depth. The composition of the bath is preferably substantially pure water (which may contain small amounts e.g. 1–2 ml/75 liters (0.00001 to 0.00002%) of the wetting agent used in the plating bath and small amounts e.g. 1–2 grams/75 liters (0.00001–0.00002%) of the conducting salt and cyanide (as a biocide) used in the plating bath). This has a density of 1 and this value is that input to the computer. The amounts of plating electrolyte dragged over to the weighting bath and water dragged back from the weighting bath to the electrolyte will not have any significant effect on composition or density of the weighing liquid in a given plating cycle. The wetting agent helps prevent air bubbles forming on the workpieces which could effect the weighing. The use of essentially pure water also has the advantage of preventing drag back of salt increasing the concentration of the plating bath such as could occur if a plating electrolyte type of liquid were used in the weighing liquid. This is not to exclude such liquids or liquids of intermediate salts concentration from use as the weighting liquid but they may be expected to have such a drawback, necessitating more careful monitoring of the electroplating bath composition.

The jig is smoothly and gently transferred from the tank 10 to the tank 50 by the hydraulic transfer mechanism 90. A typical transfer cycle is as follows. The jig is lifted vertically out of the tank 10 and held to drip for 10-15 seconds. It is then transferred to above the tank 50 and lowered down to just above the spindle 56 with the circulation pump 152 operating. The immersion is 1-2 seconds and is a first rinse. The jig is raised and then lowered for a second immersion and rinse of 1-2 seconds and raised out of the tank. The pump 152 is stopped and the balance 55 reset to zero. The jig is then lowered onto the spindle 56 and the hook 91 lowered below the cone 69. The computer checks the measured weight and continues doing this until the value has remained within the limits of accuracy of the balance for 1 minute i.e. it differs by less than 0.01 gr. The computer then accepts the measured value for the weight and calculates the weight in air of the workpieces from the input value of the density of the weighting liquid and thus the weight of the deposit formed in the previous plating cycle.

We have found that this hydraulic transfer mechanism is far more effective than a pneumatic equivalent. The jig can be lowered much more smoothly and gently onto the spindle 56 of the balance. This has the advantages of enabling a very sensitive balance to be used and enables the balance to settle to sequential readings within its level of accuracy much more rapidly thus shortening the cycle time. The use of water as the pressure fluid rather than oil avoids any contamination problems should the transfer mechanism leak. The use of water rather than an electrolyte bath avoids any problems of electroless deposition which can occur in certain systems such as gold, copper, cadmium systems used to plate 18 carat and above when the workpiece is immersed for any significant time in the plating electrolyte without current flowing.

As a less preferred but possible modification of the process the liquid in the weighting bath could be of the same composition as that in the electroplating bath. A correspondingly different density value would then be used in the calculations of the actual weight in air of the deposit.

In this instance it would probably be preferable to circulate the contents of the outer tank 51 back to the outer tank 11 via pipe 165, pump 167 and pipe 168 (as shown in FIG. 2) and then back again (not shown) to help maintain constant composition and temperature without disturbing the conditions in the inner tank 52 for weighing or the circulation in the inner tank 30 for plating.

The arrangement of FIG. 2 can also be used to top up the plating bath with water from the tank 50 by running the pump 166 in an appropriate way. This can be used to compensate for evaporation.

Care should be taken to avoid using bath compositions in this embodiment which would be liable to introduce the electroless plating problems referred to above.

The process can be used with metal models for the workpiece as mentioned and which may be e.g. fuse alloy vibratory polished and then copper plated. Such metal models may be subsequently dissolved away to leave hollow gold forms of stated carat value. The process however can have advantages also when a permanent substrate is to be used which may be metallic or a plastic with a metallized conducting surface. In addition removable wax models may be used which are given a metallized surface, e.g. of silver, and then base metal plated, e.g. copper plated, at low temperature e.g. 25° C. Once the copper form is thick enough the wax can be removed and the copper form sealed. It can then be given a gold alloy coating a described above and then the copper dissolved out leaving a stated carat gold product.

Plating bath systems which may be utilized in the method and apparatus of the present invention include those disclosed in Swiss Patents 556916 and 542934. These are alkaline gold, copper, cadmium cyanide baths containing oxyalcohol brighteners from which 18 carat gold deposits can be formed.

Other systems which could be utilized include gold, silver and gold, copper, silver and gold, copper,

I claim:

1. A process for eletrodepositing a conductive material on a substrate which comprises movably mounting the substrate in a first conductive liquid electroplating bath which contains the conductive material, maintaining substantially constant conditions of temperature and liquid circulation in the first bath, passing an electric current through the substrate and the first bath so as to deposit the conductive material on the substrate, periodically transferring the substrate to a second liquid bath, the second bath containing a liquid of the same composition or lower concentrations of dissolved ingredients as compared to the first bath, weighing the substrate when immersed in the second bath and calculating therefrom the weight in air of conductive material deposited, returninq the substrate to the first bath, and continuing the plating in a series of stages of plating, weighing in liquid and plating until the desired deposit is built up.

2. A process as claimed in claim 1 applied to the deposition of a metal alloy deposit in which after each weighing the process involves calculating the deposit composition needed for the next plating stage to achieve the final desired overall value for the deposit, and adjusting the plating current to produce the desired composition of the deposited conductive material in the next plating stage which may be the final stage or not.

3. A process as claimed in claim 1 in which the plating process is carried out in four or more stages and the electroplating bath is aqueous and the second liquid bath or weighing liquid is substantially pure water optionally containing wetting agent, e.g. 0.00001 to 0.00005% preferably that used in the first or plating bath, and optionally one or more of the conductive salts used in the plating bath e.g. 0.00001 to 0.00005%.

4. A process as claimed in claim 3 in which the liquid in the weighing bath is circulated and the substrate is dipped one or more times into the liquid while it is being circulated, the circulation is then switched off and the substrate is weighed repeatedly until the variation in the measured value is stable to within the accuracy of the measuring device.

5. A process as claimed in claim 1 in which the second or weighing liquid bath is of the same composition and concentration as that in the first or electroplating bath.

6. Apparatus for electrodepositing a conductive material on a substrate which comprises a first electroplating bath for containing electroplating liquid, means for movably mounting a substrate in the said bath, means for maintaining substantially constant conditions of temperature and liquid circulation in the first bath, means for passing an electric current through the substrate in the first bath so as to deposit the conductive material on the substrate, a second bath for containing a weighting liquid and means for weighing the substrate when immersed in the weighing liquid, means for transferring the substrate from the first to the second bath and means for transferring the substrate from the second bath to the first bath.

7. Apparatus as claimed in claim 6 in which the transfer means are hydraulically driven.

8. Apparatus as claimed in claim 7 in which the transfer means comprise vertical lifting means for lifting the substrate in and out of the bath and transverse shifting means for moving the vertical lifting means from above one bath to above the other bath.

9. Apparatus as claimed in claim 8 in which the vertical lifting means comprise a cylinder with a bore of non-cylindrical cross-section in which a piston cross-section is disposed which carries lifting means for the substrate.

10. Apparatus as claimed in claim 8 in which the transverse shifting means comprise a piston in a cylinder which affords a bearing surface for the vertical lifting means, the vertical lifting being adapted to run along the said cylinder, the transverse piston and the vertical lifting means being magnetically coupled so that movement of the transverse piston in the cylinder causes corresponding transverse movement of the vertical lifting means.

* * * * *